US005823894A

United States Patent [19]

Actor

[11] Patent Number: 5,823,894

[45] Date of Patent: Oct. 20, 1998

[54] AIR-ACTUATED BALL-THROWING AND BATTING METHOD

[76] Inventor: James M. Actor, 6557 E. Lookout Dr., Parker, Colo. 80134

[21] Appl. No.: 574,118

[22] Filed: Dec. 18, 1995

Related U.S. Application Data

[60] Division of Ser. No. 238,230, May 4, 1994, Pat. No. 5,507, 271, which is a continuation-in-part of Ser. No. 77,785, Jun. 16, 1993, abandoned.

[51] Int. Cl.[6] ..... A63B 69/40

[52] U.S. Cl. ..... 473/422; 124/56

[58] Field of Search ..... 473/115, 103, 473/102, 65, 422, 564; 124/56, 73

[56] References Cited

U.S. PATENT DOCUMENTS

| | | | |
|---|---|---|---|
| 51,229 | 11/1865 | Smith | 124/73 |
| 2,964,321 | 12/1960 | Anderson | 473/422 |
| 3,179,412 | 4/1965 | Niederberger | 473/422 |
| 3,584,614 | 6/1971 | Horvath | 124/56 |
| 3,911,888 | 10/1975 | Horvath | 124/56 |
| 4,207,857 | 6/1980 | Balka, Jr. | 124/56 |
| 4,291,665 | 9/1981 | Bash | 124/56 |
| 4,372,283 | 2/1983 | Balka, Jr. | 124/56 |
| 4,570,607 | 2/1986 | Stokes | 124/56 |
| 4,682,773 | 7/1987 | Pomllia | 473/422 |
| 4,886,269 | 12/1989 | Marocco | 273/30 |
| 5,044,350 | 9/1991 | Iwabuchi et al. | 124/51.1 |
| 5,160,131 | 11/1992 | Leon | 273/26 |
| 5,257,615 | 11/1993 | Jones | 124/56 |
| 5,456,461 | 10/1995 | Sullivan | 473/564 |

*Primary Examiner*—Theatrice Brown

*Attorney, Agent, or Firm*—Dorr, Carson, Sloan & Birney, P.C.

[57] ABSTRACT

Apparatus for propelling balls smaller than a baseball, such as a golf whiffle ball, at timed intervals from a storage bin. The bin contains a plate with a single hole that rotates at timed intervals and permits one ball to be delivered to a continuous air source to propel the ball to a batter. This small ball is then hit with a bat that is smaller and lighter in weight, than an ordinary baseball bat. By design, the storage bin has a mix unit in it to prevent the balls from forming a gridlock or jamming, thereby preventing normal timed operation.

3 Claims, 7 Drawing Sheets

1
1a
2
3
5
10
11
12
13
14
15
15a
16
20
30
40
41
50
51
52
53a
53b
55
60
61
62
63
70
71
72
604
80
81
90

720
8
8
52
53a
700
54a
702

52
53b
54b
710

14a
11
13a
14
1
2
810
10a
10
1a
16
13
12

30
71c
90
51
7(b)
52
7(c)
71a
14
71b
41
702
7(b)
7(c)
53b
53a
55
70a
50

Fig. 9
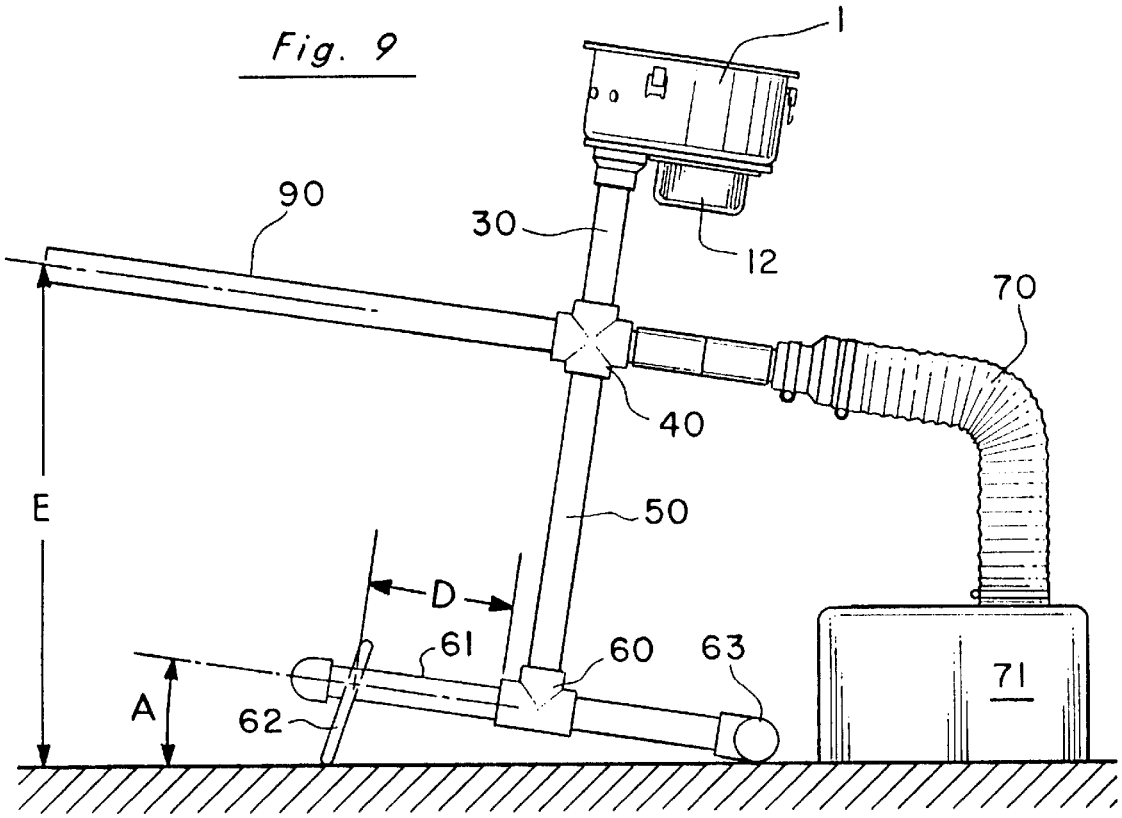
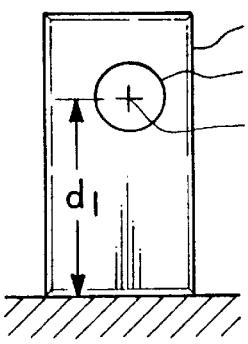
Fig. 10(a)
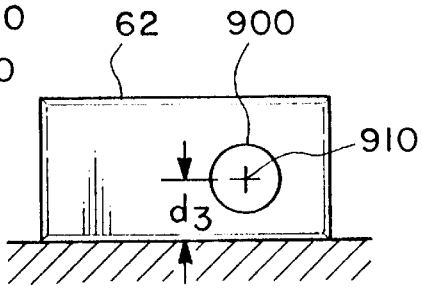
Fig. 10(b)
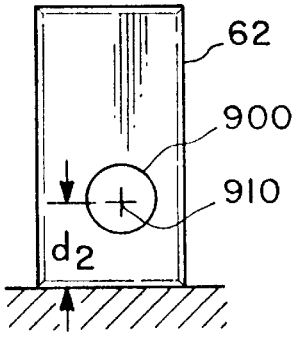
Fig. 10(c)
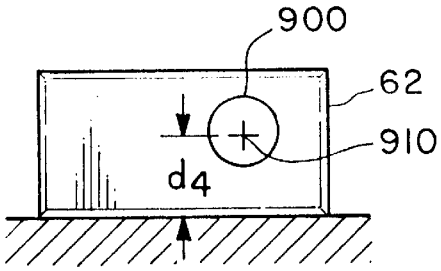
Fig. 10(d)

AIR-ACTUATED BALL-THROWING AND BATTING METHOD

RELATED INVENTION

This is a divisional of application Ser. No. 08/238,230 filed on May 4, 1994, (U.S. Pat. No. 5,507,271) entitled "Air Actuated Ball-Throwing Device and Method Therefor," a continuation-in-part of Ser. No. 08/077,785 filed on Jun. 16, 1993, entitled "Air Activated Ball Throwing Device," which has been abandoned.

BACKGROUND OF THE INVENTION

1. Field of the Invention

This invention relates to a projectile-propelling device and, more particularly, to an air-driven, automatically actuated device for propelling a small-diameter ball, for being hit by a lightweight, small-diameter bat for baseball batting practice.

2. Statement of the Problem

There are many ball-throwing machines on the market. Most require at least two people to operate, and most are not suitable for young children to use by themselves because of possible injury from the propelled ball.

While there are many conventional ball-throwing devices on the market, there is a need for a simple and inexpensive automatic ball-throwing device for a lightweight ball that, along with a small-diameter bat, will improve the user's batting skills. A majority of such conventional baseball throwing machines deliver the ball to be hit in a small-diameter strike zone such as 6–8" and require operator assistance in changing the type of ball delivery (curves, slider, riser). Such a machine delivers the same pitch over and over again in the small batting zone. To deliver a random selection of different pitches, the machine must be manually changed. This causes the batter to develop timing and groove his swing in the strike zone for a single type of ball delivery. This does not develop the "eye on the ball" practice needed to hit the ball with the bat as occurs in a game. These machines also deliver a normal sized and weight ball (i.e., a hard ball weighing 9 oz.) to the batter at speeds of 60 to 70 m.p.h. Because a normal weight bat (i.e., 24–34 oz.) is used, this physically curtails the batter to hit a limited number of balls such as 50 to 100 deliveries before fatigue sets in. Such a low number of deliveries is not beneficial to establishing hand-eye coordination. At these delivery speeds and weights, the area around where a baseball is thrown is dangerous and not suited for young children.

Also, most baseball throwing machines require a large outdoor area for use that makes them impractical during inclement weather. A need, therefore, exists for a device that is simple and inexpensive with few moving parts.

A need further exists for this device to be able to be operated by one person. Such a device needs to be safe for young persons to operate by themselves and not be subject to injury by the projectile that is thrown. Further, the device must be able to place the projectile (ball) in different places randomly, so that the batter does not just groove his swing and make contact with the ball. In addition, the ball needs to have a smaller circumference than a regular ball used in games and needs to be hit by a smaller, lighter weight bat than is normally used in games to develop a narrowed hit zone. Further, the device needs a simple means for a young person to independently change the speed and trajectory of the ball.

A need exists that this device can be used inside of a house in a garage or basement and not do damage to the house when used, and be used in any type of weather.

This combination of small ball and small bat narrows the hitting zone (i.e., the area of bat/ball contact to have a hit) for practice. When batters develop proficiency with this narrowed hit zone, they will be able to hit the larger hit zone much easier. The present invention is not designed to replace such conventional machines, but is designed to provide a new exercise—i.e., to improve "eye on the ball" skills.

3. Prior Patented Approaches

The following patent relates to various types of the conventional pitching machines discussed above.

U.S. Pat. No. 5,044,350 entitled "Pitching Machine," by Iwabuchi, et al., is capable of providing a variety of pitching styles such as fast balls, curve balls, sliders, etc. In the second embodiment of Iwabuchi, a storage chamber is divided into a plurality of compartments with each compartment having space for approximately ten balls. Each compartment is open at the lower end, and a slider is used to dispense a ball out of a selected compartment. The selected ball is then dropped into a supply tube, which causes the selected ball to drop into a feed tube extending perpendicular to the access of the supply tube. Air from a blower propels the ball in the feed tube and into a flexible hose. The flexible hose causes the propelled ball to be delivered into a feed nozzle wherein the delivered ball is grabbed on opposing sides by urethane wheels that propel the ball in a trajectory to be hit by a batter. The spacing between the wheels can be selectively adjusted to vary the pitching. By adjusting the spacing and the speed of rotation of the urethane wheels, a variety of pitching styles are achieved. The wheels are typically rotated at 1200–2400 rpm. For example, 74 mm(about 3") hardballs were delivered at speeds of 134 km/H in a strike zone of 144 mm×250 mm (about 6"×10") 18.4 m (about 60 ft.) from the machine. This occurred 96% of the time. This patent illustrates the high speed, small strike zone, and manual adjustment required to obtain different pitching styles. The Iwabuchi et al. approach requires manual adjustment of the urethane wheels and the orientation of the urethane wheels to achieve the variety of pitching styles.

U.S. Pat. No. 4,207,857 issued to Balka, Jr., entitled "Automatic Ball Server" provides a bucket of balls such as tennis balls and utilizes compressed air to fire the balls. Balka utilizes three main components: a compressed air bucket, a ball feed bucket, and a base stand that supports the invention. The firing barrel of Balka can be selectively adjusted to have different trajectory elevations. Balka utilizes a cylindrical portion that rotates within the storage area. Rotor holes are formed in the bottom of the cylindrical portion and capture a ball. A guide plate is oriented above an opening so that when a captured ball in a rotor hole aligns over opening, the guide plate causes the captured ball to drop through the opening and prevents other balls from dropping into the hole opening. The captured ball then falls or rolls down into a tube where it is picked up by the flow of air from an air compressor. The ball is then blown out through the firing barrel. A detent is used to stop the ball in order to enable air pressure to build up behind the ball. When a pressure point is reached, the detent releases the ball and the ball is fired with great force through the firing barrel and out the muzzle. Speeds from 20 to 55 miles per hour are achieved. The firing time of successive balls can be controlled by the rate of rotation and the capturing of the balls. Balls can be fired every 3.5, 7, or 14 seconds by plugging one or more holes in the rotor. An oscillating mechanism at the base of the machine can be activated so as to oscillate the machine so that the balls will be fired in random directions. Separate holes in the firing barrel can be selectively uncovered to vary the discharge speed of the ball.

U.S. Pat. No. 5,257,615 issued to Jones sets forth a baseball, softball, and tennis ball training device. In this design, a conventional leaf yard blower can be utilized as the source to propel the balls. Various-sized curved and shaped tubing can be utilized to throw various pitches. Jones recognizes the problem associated with conventional high-speed machines that throw baseballs and softballs. Jones also recognized that a simple and inexpensive device shooting whiffle balls corresponding in size to conventional baseball and tennis balls could be utilized at speeds less than achieved by conventional machines so as to improve batting averages. Jones utilizes a conventional leaf blower as an air source. In one embodiment, Jones uses an automatic ball feeder. It uses a rotating cam or scoop to dispense one ball on a timed basis. A visible flag 38 warns the batter when a ball is to be hurled. Jones provides an adjustable stand 25 that provides different trajectories of the ball by sliding up and down the tube. Jones uses different shaped tubes to provide different pitching styles.

U.S. Pat. No. 4,570,607 issued to Stokes sets forth a pneumatic tennis ball-throwing machine. U.S. Pat. No. 4,886,269 issued to Marocco sets forth a table tennis practice aid for Ping Pong balls that uses compressed air to deliver each Ping Pong ball. The 1992 patent to Leon, U.S. Pat. No. 5,160,131, also uses a pneumatic system to propel balls.

A needs exists for a safe ball delivery machine that delivers a lightweight ball, such as a whiffle ball, at low speeds, one that can be used by children and one that can be used indoors such as the garage or basement of a house. A need also exists for a ball delivery machine which is inexpensive, easy to transport, and one that can be used year round. A need also exists for a ball delivery machine that has few moving parts, can be operated by a single person and that is capable of delivering balls over random trajectories without adjustment to the machine. A need also exists for a machine that provides a visual indication of ball delivery just prior to delivery.

4. Solution to the Problem

The present invention offers a solution to the above problems. It is simple in operation and devoid of electronics and heavy springs and other expensive components.

The present invention provides for automatic delivery of the ball so that it can be used by an individual person who derives all the advantages it is intended for. The projection of a whiffle ball precludes injury from the projectile coming out of the machine.

This makes the invention safe for use by children. The invention can also be used indoors without damage to interior wall surfaces. Hence, the present invention can be used year round unlike other conventional batting machines. By using a suitable air source such as a vacuum or air-blowing device in combination with the whiffle ball, the ball is randomly delivered over a wide strike zone area. This random movement takes place because of a combination of the air and whiffle ball. As the whiffle ball is repeatedly hit, the ball slightly deforms so it will always take a different trajectory with each new delivery. Therefore, the batter cannot groove his swing and still hit the ball; the movement requires the batter to keep his eye on the ball in order to hit it.

By using a small whiffle ball of about 1.5 inch diameter and about a 1 inch diameter bat, the batter is developing hand-eye coordination in about a small 2.5 inch hit zone. With practice on this small hit zone, batters find it much easier to hit in a full 6-inch (3-inch bat and 3-inch or larger ball) hit zone.

By moving a pad spacer fore or aft under the front leg of the device, the trajectory of the ball can be easily varied. Also, by simply turning a cover over slots (openings) in the air tube or adjusting a rheostat, the speed of the ball can be varied to accommodate ranges of skill from that of the youngest batter to that of a professional batter. Because a whiffle ball is used, and because lower speeds are used (i.e. 5 to 30 mph) the batter can be located 12 to 15 feet away from the machine. Since the batter is only one-fourth the normal hitting distance away from the machine, when the ball is propelled at 20 mph, the equivalent speed is about 80 mph. Since the batter can be as close as 12 to 15 feet from the machine, and whiffle balls are used, the device can be used in a garage or basement during inclement weather.

Finally, the present invention allows the batter to hit 150 to 300 repetitions per day without fatigue. This is due to the slow delivery speeds and the lightweight of the ball and bat. This compares to 50 to 100 repetitions for conventional ball delivery machines.

SUMMARY OF THE INVENTION

The present invention propels a lightweight ball (i.e. less than about one ounce) automatically at timed intervals. This lightweight ball of small diameter is then hit with a small diameter bat, providing a less than half size "hit zone" as compared to an ordinary baseball hit zone. Blowing air is directed through tubing. The tubing incorporates two slots in the bottom of the tube to vent air out of the tubing. Covers are utilized to adjust the amount of venting so as to adjust the overall air speed, which in turn adjusts the speed of the ball. The supply bin is above the tube from which the ball is propelled. The lightweight balls are automatically drawn from the ball supply bin. Unrestricted, air from the air source would go up the supply tube and prevent a timed delivery of the balls. Therefore, a small curved tab is incorporated in the delivery air tube. This tab increases the speed of the air, thereby reducing the pressure, which causes a vacuum that draws the ball down from the ball dispensing tub. The ball is then propelled out a short length of tube that causes the ball to develop the velocity of the air being blown through the tube. A flanged and curved piece is attached to the supply reservoir. This causes the balls to mix and prevents gridlock. It is located near the ball dispensing tube so that only one ball at a time can go down the dispensing tube, thus preventing multiple delivery of balls at one time.

To provide the timing intervals of the balls to be hit, a plate with a hole in it is rotated in the supply bin by an electric motor attached to a gear box. The combination of motor speed and gear box provides one rotation of the plate every 4 to 7 seconds, permitting only one ball to be introduced to the dispensing tube. This timing can be a fixed time as determined by the voltage of the transformer applied to a DC electric motor, or variable by using a rheostat between the electrical source and the electric motor.

Velocity of the air and therefore the velocity of the ball can be controlled in two ways. The air can be bypassed via slots in supply tube that vents the air prior to the introduction of the ball. Or, this vent hole can be closed off and a rheostat can be used prior to the air source, such as a vacuum on the blowing port, thus controlling the speed of the air source and thereby controlling the velocity of the blowing air from the air source.

By utilizing a 1-inch dowel to hit the 1.5-inch ball, a 2.5-inch hit zone is developed to practice hand-eye coordination. By utilizing a 1-inch wood dowel, the batter can practice more repetitions without developing fatigue than with a regular, weighted bat. Also, this small hit zone requires the batter to keep his eye on the ball to make contact with the ball. Due to the blowing air mixing with ambient room air, the uneven distribution of weight of the balls and the uneven contour of the balls, the balls are delivered to the batter over a strike zone much larger than a strike zone for conventional ball delivery machines which is about 6 inches from high to low. With our unit, high to low is about 30 inches. Therefore, by hitting the ball with a 1-inch bat, the batter cannot groove his swing and make contact with the ball as with conventional ball delivery machines. The contour of the balls is changed after they are hit due to the impact of the bat and ball. When the balls are thereafter sent through the throwing device, the combination of air, ball quality, and changed contour will at higher air speeds cause the balls to be delivered in curves, risers, and sinkers in a random manner without any operator intervention or assistance.

DESCRIPTION OF THE DRAWING

FIG. 9 is a side planar view of the present invention illustrating the adjustment of the trajectory of the ball.

FIGS. 10*a*–(*d*) illustrate the trajectory-adjusting mechanism of the present invention.

DESCRIPTION OF THE PREFERRED EMBODIMENT

1. General Discussion of Invention

Figures 1, 2, 3:
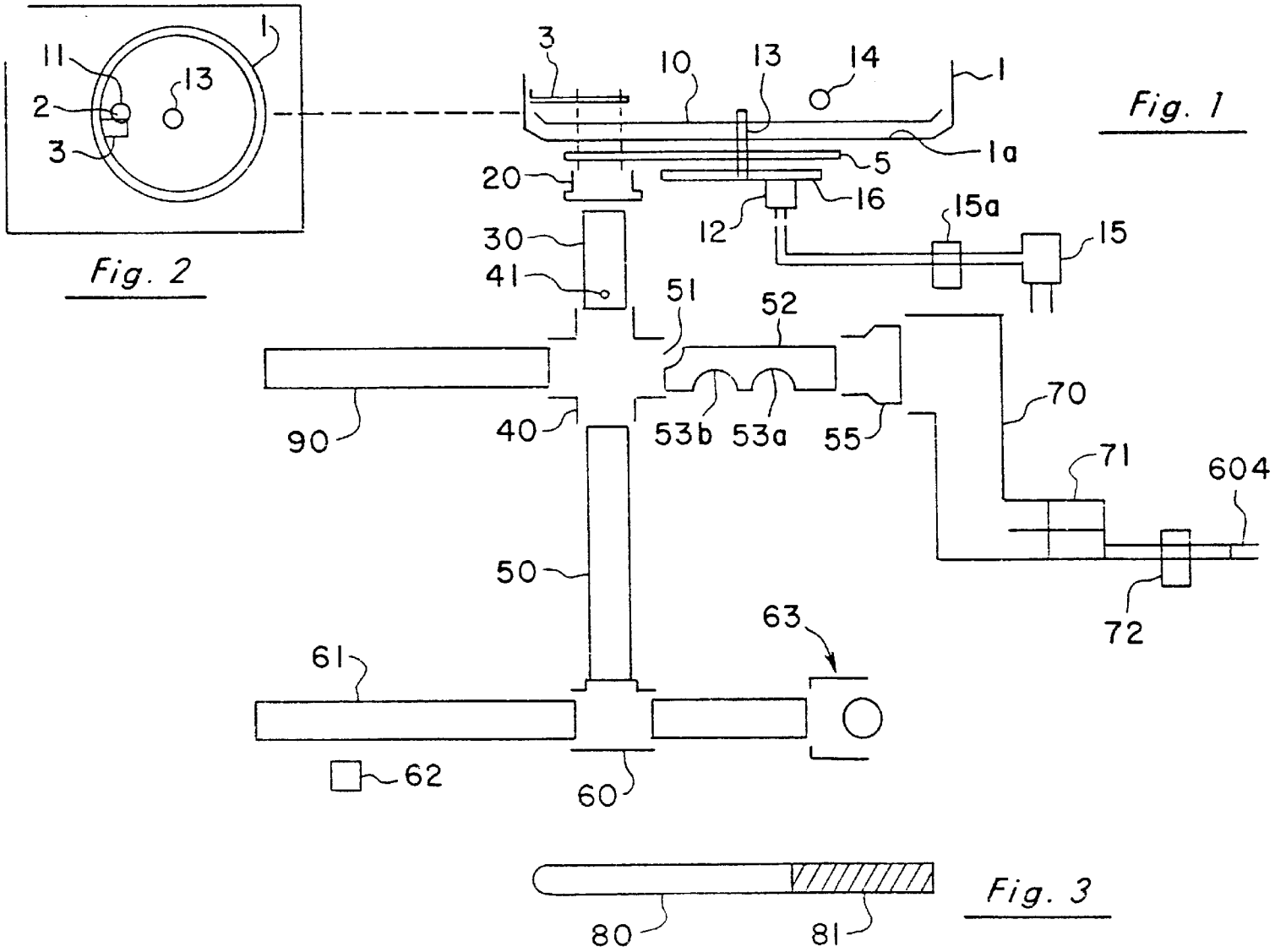
FIG. 1 is a side elevation view of the preferred embodiment of my invention.
FIG. 2 is a top view of the ball supply bin and dish.
FIG. 3 is a side planar view of the bat of the present invention.
Figure 6:
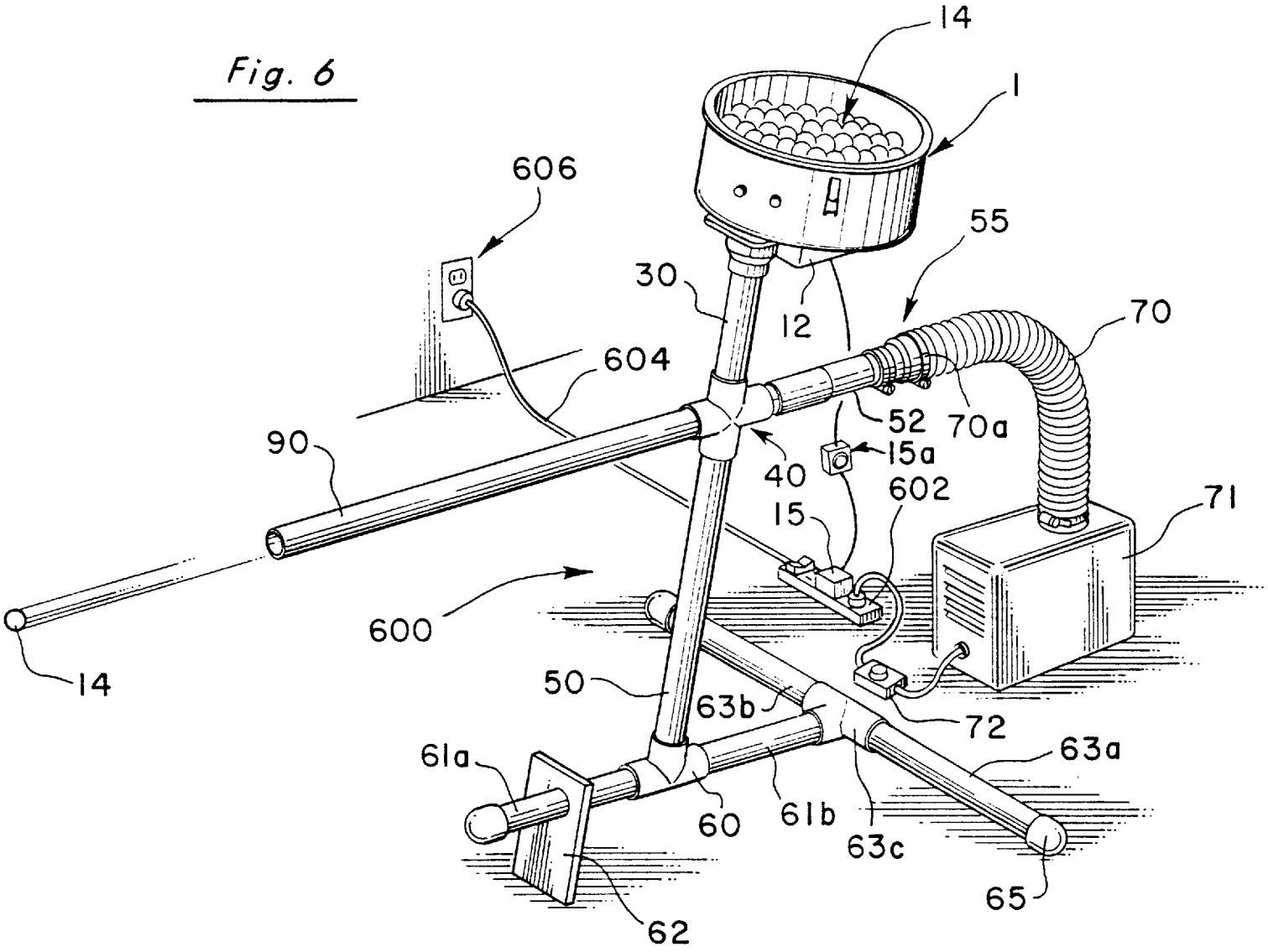
FIG. 6 is a perspective view of the ball throwing device of the present invention.

In FIGS. 1 and 6, components of the air-actuated ball-throwing device of the present invention include: an air source 71 that is connected to an optional rheostat 72, which in turn is connected over cord 604 to a standard AC outlet (not shown); a shooting tube 90; and a support stand comprising forward member 61 and a horizontal member 63 along with an upstanding member 50. Connected to the top of upstanding member 50 is a shooting tube 90 and an air inlet tube 52. A clear dispensing tube 30 delivers balls 14 stored in a ball supply bin 1.

The air source 71 is electronically interconnected to rheostat 72 that, in turn, is connected over power cord 604 to a standard AC outlet (not shown). The air source 71 delivers air upwardly and into flexible air pipe 70, which provides the propelling force to launch a ball 14 from the end of shooting tube 90, as illustrated. A supply of balls 14 is found in the supply bin 1.

Blowing air is introduced from an air source 71 such as the blower port of an upright vacuum, a shop vacuum, or a weed blower. A rheostat 72 can be optionally placed in the electrical line to provide for varying speeds of the air source 71. This blowing air is then introduced into flexible air pipe 70, which is attached by tape or mechanical fastening 70*a* to the pipe (PVC type or other similar piping) 52. An adapter 55 for different circumferences can be optionally used to provide smooth air flow without loss of air pressure from the source 71.

As can be observed, the present invention is of simple and inexpensive construction. The ball thrower of the present invention is lightweight weighing approximately 12–16 lbs. (without the blower 71 being included). The ball thrower can be easily transported from location to location and can be used indoors or outside. It is to be expressly understood that the components discussed above, while preferred, could be of any suitable component of equivalent function.

2. Control of Air Pressure

Figures 7A, 7B, 7C:
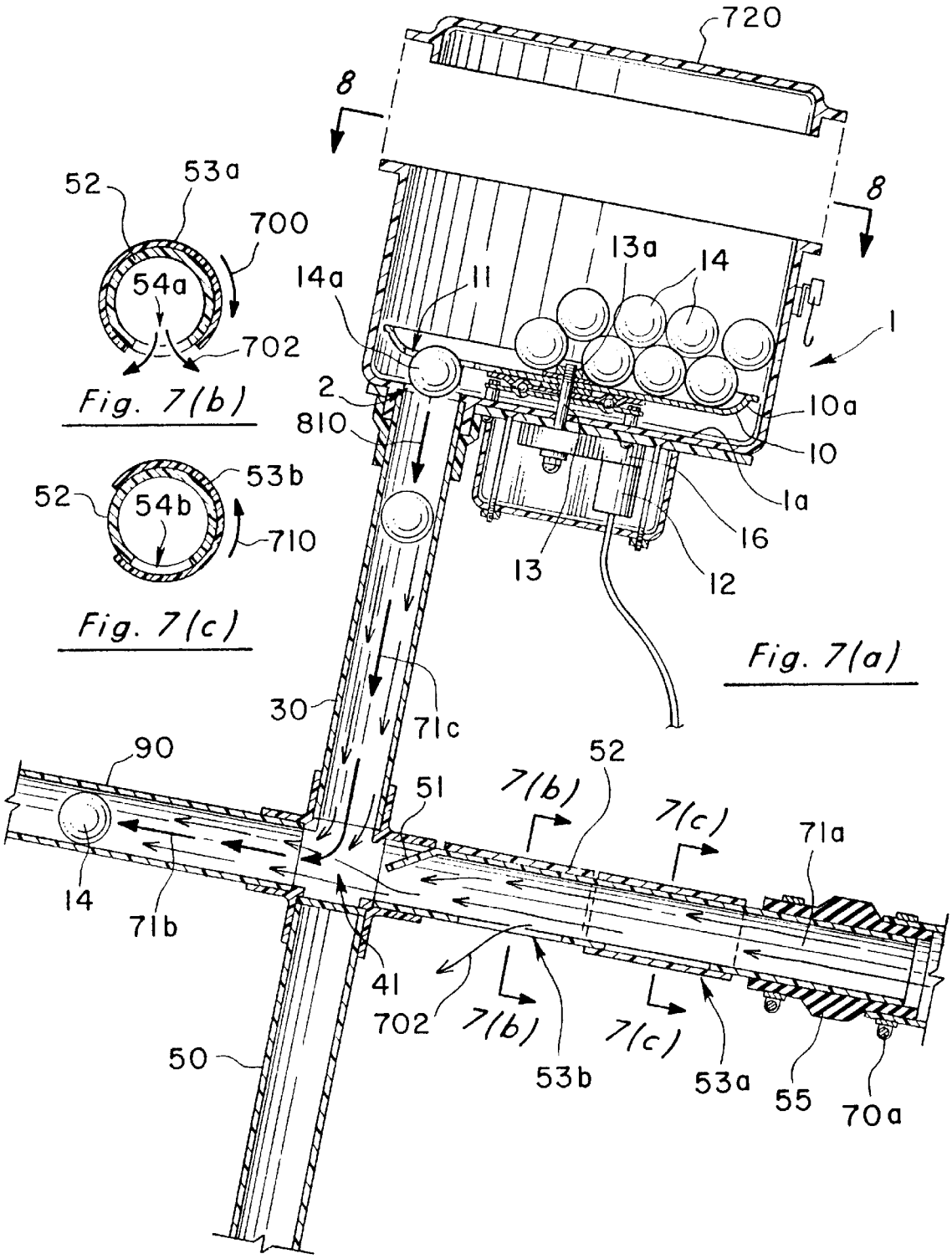
FIG. 7*a* sets forth a partial cross-section showing the dispensing of balls.
FIG. 7*b* sets forth an adjustment to the velocity of the ball.
FIG. 7*c* sets forth the closed position of the velocity adjustment of FIG. 7*b*.
Figure 8E:
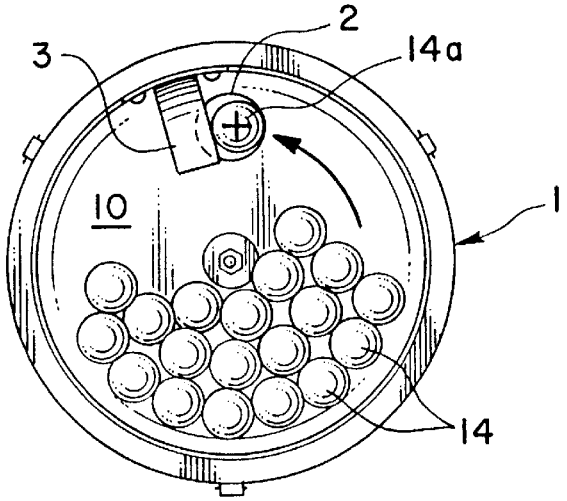
FIGS. 8*a*–(*e*) illustrate the selection of a ball for dispensing from the ball supply bin and dish of the present invention.
Figure 8A:
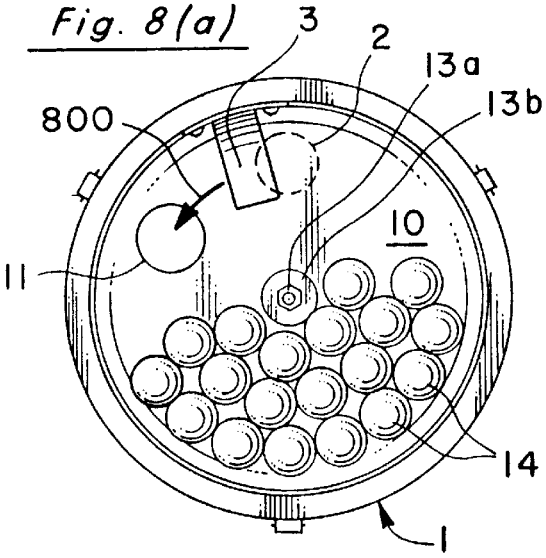
Figure 8D:
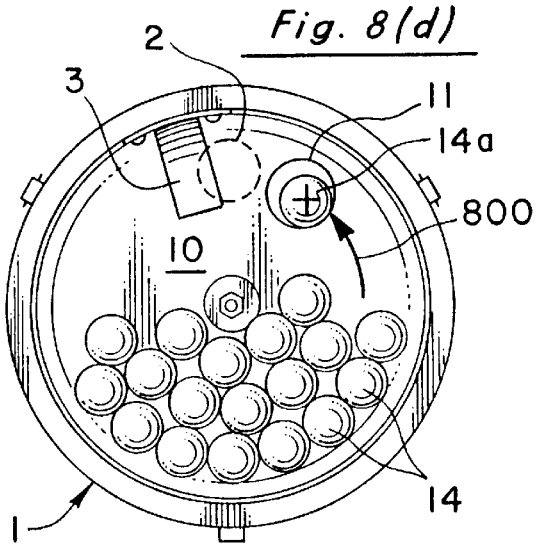
Figure 8B:
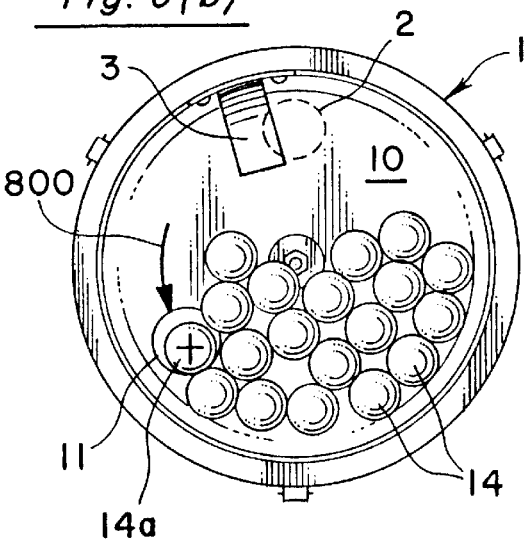
Figure 8C:
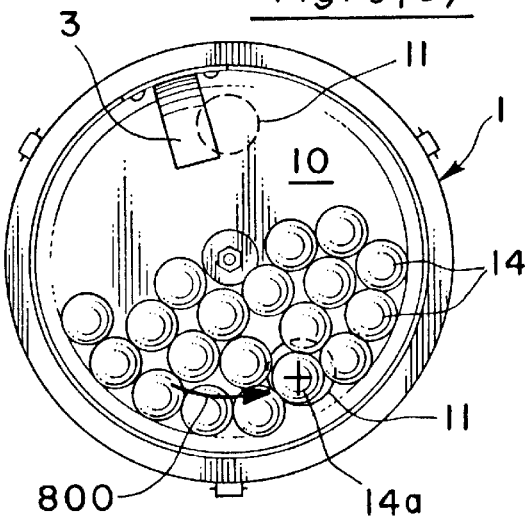

In FIGS. 1 and 7, the details of two slots 53*a* and 53*b* are provided. This is a first approach for controlling the amount of air pressure so as to control the velocity of the thrown ball. It is to be expressly understood that the existence of these slots and the size number of slots are optional under the teachings of the present invention. For example, their presence could be eliminated and the use of the rheostat 72 could be relied upon to control the pressure being delivered from the air source 71. As shown in FIG. 7, the first slot 53*a* as shown in FIG. 7*c* is closed. The second slot 53*b* as shown in FIG. 7*b* is open. In each case, the slot 53 has a plastic cylindrical shaped cover partially covering tube 52 that it can be easily twisted in the direction of arrows 700 and 710 to partially open or close the respective openings 54. Openings 54 are cut or formed in the plastic tube 52. When the hole 54 is open as shown in FIG. 7*b*, the air from the air source 71 is partially delivered outwardly as shown by arrows 702 in FIG. 7*b*. The slots 53 are designed to redirect air out of holes 54 in the bottom of pipe 52. This enables the operator of the present invention to redirect or bypass air 71*a* from the source 71 out the bottom of the tube 52, which causes more or less air to go through the shooting tube 90. When opened, less air shoots the ball 14. By so doing, this changes the velocity of the ball 14 that comes out of the shooting tube 90 for a batter to hit. Delivery speeds of a few mph to about 30 mph are achieved through selective adjustment of slots 53.

A second embodiment to control the amount of air pressure is to adjust rheostat 72 which controls the amount of electricity used by air source 71.

3. Creation of Vacuum Pressure

In FIGS. 1 and 7, the creation of the vacuum in dispensing tube 30 is shown. Incorporated in tube 52 is a tab 51 that is preferably cut from the material of tube 52 and is bent down to decrease the tube area by about 20 to 50 percent. The amount of decreased area is not critical to good operation, but 50 percent is best. This causes an increase in air velocity at joint 41 with a resultant decrease in pressure and yet allows enough air volume through to propel ball 14. Without the tab 51 restriction, the blowing air 71*a* from the air source 71 would partially go up tube 30 and prevent the lightweight balls 14 from going down tube 30. The tab 51 causes the velocity of the air to increase at point 41, thereby reducing pressure, creating a vacuum in tube 30 that pulls 71*c* the balls 14 down clear dispensing tube 30. When the ball drops down past point 41, the blowing air then propels the ball out of the shooting tube 90. It is to be expressly understood that the tab 51 could be a separate part glued into the tube or that the tab can be any equivalent structure which creates a vacuum as discussed.

4. Sighting of the Ball

Dispensing tube 30 is made of clear plastic. This enables the ball to be visible so the batter can anticipate when the ball 14 will come out of shooting tube 90.

An alternate approach is simply to cover tube 30 with paper so that the batter can then only see ball 14 when it comes out of shooting tube 90. This gives the batter an alternative depending on his skills and needs. Covering tube 30 can help some batter's reflexes as they have less time to anticipate delivery of the ball 14.

5. Ball Delivery Timing

As seen in FIGS. 7 and 8, the timing for the ball delivery is achieved by the rotation of the plate 10 in the ball supply bin 1. An electric motor 12 is connected to a gear box 16 that turns shaft 13 that is fixed via a bolt 13*a* to plate 10. The speed of the electric motor 12 and the gear ratio of the gear box 16 that turns the shaft 13 to which the plate 10 is attached determines the time intervals between when the ball 14 drops into the tube 30. The combination of motor 12 and gear box 16 and transformer 15 can be fixed to cause plate 10 to rotate at a preferred dispensing speed such as one revolution per 4 seconds. However, any suitable speed could be designed. Timing can be changed to the desired interval between ball delivery in multiple ways. By using a DC electric motor 12, the voltage of the transformer 15 can be changed to change timing. Or, the gears in the gear box 16 can be varied, to provide any time interval between each ball delivered. Or, a rheostat 15*a*, as shown in FIG. 1, can be utilized between the motor and source of electrical power to vary the speed ratio of the gear box 16 and therefore the speed of plate 10. The preferred embodiment is most economical by: (1) using a 24-volt DC motor 12, (2) using a 12-volt transformer 15, (3) providing proper gearing for the gear box 16 to drive shaft 13 at one revolution every 4, 5, or 6 seconds, (4) causing plate 10 to rotate at the same rate, and (5) permitting a ball 14 to drop into tube 30 in order to be propelled out of shooting tube 90.

While a preferred design is set forth for controlling the speed of ball delivery, it is to be expressly understood that any suitable design for varying the pickup rate of balls 14 could be incorporated under the teachings of the present invention.

6. Supply Bin.

As shown in FIGS. 1, 6, 7, and 8, the supply bin 1 is cylindrical to confine a plurality of balls 14 rolling over circular plate 10. By having the diameter of a formed capture hole 11 slightly larger than the diameter of a ball 14 and by locating the hole 11 in the outer circumference of plate 10, a single ball will roll into the hole 11 each revolution of plate 10. When the hole 11 in plate 10 lines up with the formed dispensing hole 2 in the supply bin 1, the ball will roll into dispensing tube 30, where the lower pressure air 71*c* at point 41 draws the ball down as illustrated in FIG. 7*a*.

This is fully illustrated in FIG. 8. As shown in FIG. 8*a*, the plate 10 rotates counterclockwise in the direction of arrow 800. The formed capture hole 11 rotates with the plate and selects one ball 14*a* from the supply of balls. The balls 14 are congregated toward the end of the bin 1 due to the incline relationship of the present invention as shown in FIGS. 6 and 7. The bin 1 remains stationary while the plate 10 rotates counterclockwise. Plate 10 has a diameter somewhat less than the inside diameter of the bin 1. As shown in FIG. 7*a*, the plate 10 has upwardly curved sides 10*a* configured somewhat like a pie plate. The plate 10 is held to the shaft 13 via a washer 13*b* and a nut 13*a*. As shown in FIG. 8*b*, the hole continues to rotate in the direction of arrow 800 and selects a ball 14*a*. The selected ball 14*a* is captured in the formed hole 11 since it slightly drops down to abut the bottom wall 1*a* of the bin 1. This distance is clearly shown in FIGS. 1 and 7 as the distance between plate 10 and the bottom wall 1*a*. The selected ball 14*a* in the hole 11 continues to travel in the direction of arrow 800 as shown in FIG. 8*c*. The movement of the selected ball 14*a* through the other balls 14 causes a slight stirring action of the remaining balls 14. As shown in FIG. 8(*d*), the rotating plate 10 causes the selected ball 14*a* to approach the formed hole 2 in the bottom 1*a* of bin 1. As shown in FIG. 8(*e*), the selected ball 14*a* aligns over the formed dispensing hole 2 and the tab 3 positively prevents the ball 14*a* from continuing another rotation around the bin. As shown in FIG. 7*a*, ball 14*a* drops in the direction of arrow 810.

The plastic tab or flange 3 is affixed to the side of the ball supply bin 1. This comes in contact with the balls 14 as plate 10 rotates. When there are numerous balls 14 in the supply bin 1, they can become fixed on the plate 10 or gridlocked, preventing a ball from falling into the hole 11 in the plate. This would prevent delivery of the ball 14 in a timed sequence. With the plastic (or other suitable material) tab 3 fixed to the side of the supply bin 1, the balls are consistently agitated to cause at least one ball 14*a* to fall into the hole 11 in the plate on each rotation of the plate 10. This causes the selected ball 14*a* to be delivered out tube 90 in the desired timed period. This flange also prevents jamming of the ball 14*a* at the opening to tube 30. Being located above and off center of opening 2, the flange only permits one ball 14*a* at a time to enter tube 30.

A lid 720 is provided over the top of the supply bin 1. The lid 720 is optional and can be used when all the air available from air source 71 is used to cause ball 14 to be delivered at its highest velocity.

It is to be expressly understood that the design illustrated in FIGS. 1, 7, and 8 is for a preferred embodiment that is simple and inexpensive to construct. Other suitable designs, under the teachings of the present invention, could be utilized to store balls 14, to agitate the balls 14 so as to ensure capture of a single ball 14*a*, and then to deliver a captured ball 14*a* at a predetermined time sequence as fully illustrated and explained above.

7. Adjusting the Trajectory of the Ball

FIGS. 1, 9, and 10 show how the trajectory of the ball 14 coming out of tube 90 can be varied by moving a pad 62 along the front leg 61 of the stand and thereby changing the elevation of tube 90. This pad or spacing device 62 can be of any suitable material such as plastic or foam, or a spacing device can be attached to the leg 61 that can be moved fore or aft, to change the angle A that the stand sits on the floor, thereby changing the elevation E of the shooting tube 90.

As illustrated in FIGS. 9 and 10, the pad 62 can be of rectangular design and can be formed from plastic. A hole 900 can be located wherein its center 910 is located at different distances $d_1$ through $d_4$as illustrated in FIGS. 10*a* through 10(*d*). As illustrated in FIG. 10, $d_1$ is greater than $d_2$ and $d_4$ is greater than $d_3$. By providing offset distances for the hole 900, the user of the present invention can arrange the pad 62 to provide different angles A for the shooting tube 90. Each different angle A results in the different elevation E for the shooting tube 90, which affects the trajectory of the ball exiting from the shooting tube 90. In addition, the pad 62 can be moved along the tube 61 a distance of D so as to provide further adjustments for the elevation E. Finally, the formed hole 900 is greater in diameter than the diameter of tube 61 so that the pad 62 can be angled to provide an additional fine adjustment to angle A. Essentially, the pad 62 provides a large number of angles A that relate to a large number of different trajectory elevations E. The pad 62 represents an inexpensive approach to elevating the shooting tube 90.

Figure 4:
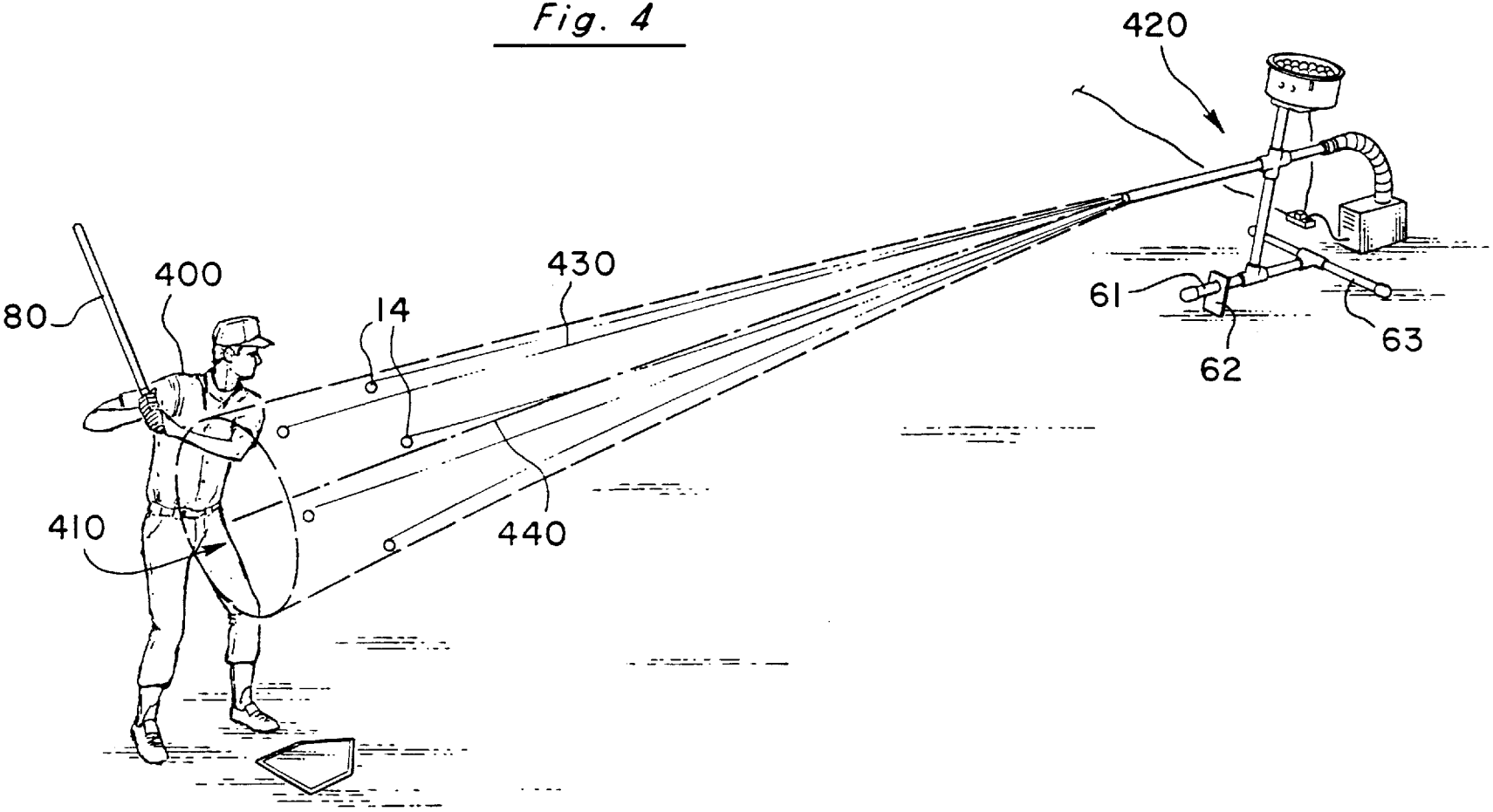
FIG. 4 is a perspective view illustrating the present invention in operation.

The pad 62 causes the entire invention to pivot about the rear support tube 63. Because the rear support tube 63 is orthogonal to the tube 61, the use of the pad 62 provides a stable support for the entire shooting apparatus of the present invention as illustrated in FIG. 4. It is to be expressly understood that other designs could be utilized under the teachings set forth above to selectively elevate the shooting tube 90 of the present invention.

8. Design of Ball 14 and Bat 80

Figure 5A:
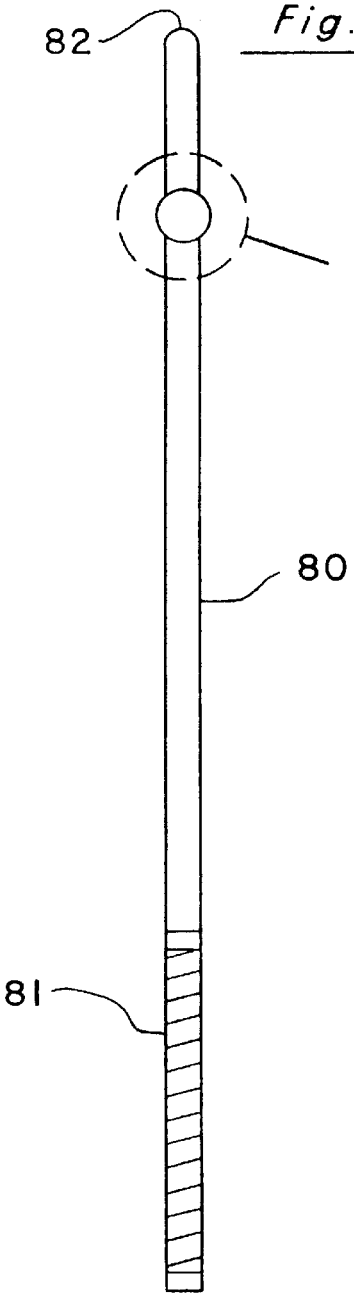
FIGS. 5*a, b*, and *c* set forth the relationship of the diameter of the ball to the diameter of the bat of the present invention.
Figure 5B:
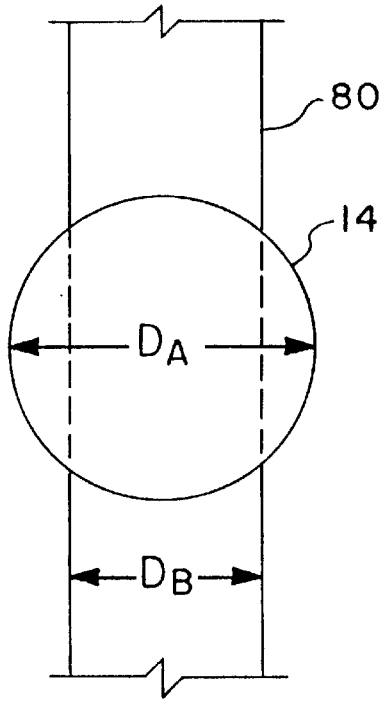

In FIGS. 3 and 5, the preferred ball 14 can be a generic type of golf whiffle ball. This type of ball has a preferred diameter $D_A$ of 1.5 inches, is hollow, weighs less than about two ounces, and is designed to be hit. In the preferred embodiment, the ball weighs 0.4 ounce. It is to be understood that the ball can have a diameter of less than about two inches under the teachings of the present invention. This type of ball can be made of plastic or similar material, or can be a foam material of similar weight.

The bat 80 is preferably constructed of plastic tube material that has, optionally, hand wrapping 81 at one end. The end 82 of the bat may be open or closed. The bat 80 could also be constructed of wood or other similar hard and durable material such as plastic, tubing, etc. The bat is preferably the same length as conventional bats and weighs 14 oz. It is to be understood that the weight can be less than about 16 oz. under the teachings of the present invention. The bat has a preferred small diameter, $D_B$, of 1 inch. It is to be understood that the small diameter can vary within a range of about 0.5 inch to 1.5 inches and still fall within the teachings of the present invention. The term about one inch shall mean 1±0.5 inch.

Figure 5C:
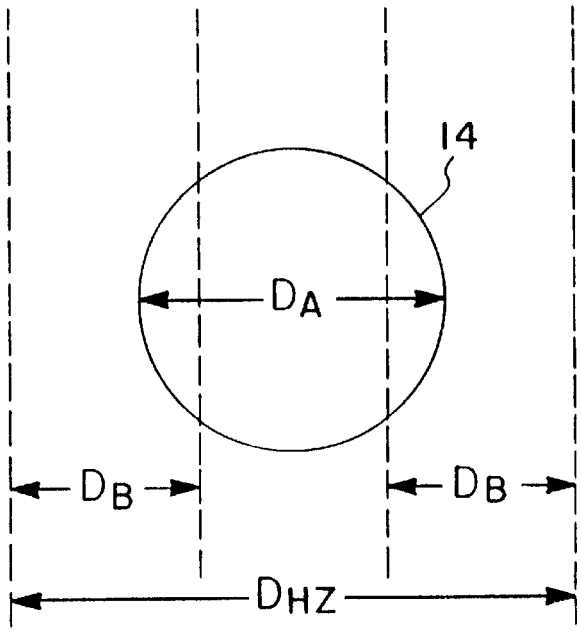

The concept of a golf whiffle ball 14 being hit by a one inch bat 80 is an important feature of the present invention. The development of this small hit zone (compared to the larger hit zone of a normal bat and ball used in baseball games) is what forces the batter to keep his eye on the ball in practice. This is illustrated in FIG. 5*c* wherein the hit zone $D_{HZ}$ has a distance of just less (i.e., ½ inch on each side) than $D_A+2D_B$, or, in the preferred embodiment, 1.5 inch+2(1inch) −2(½ inch)=2.5 inches. Under the teachings of the present invention, the hit zone is small being less than about 3 inches. This is considerably smaller than the conventional hit zone. A conventional 3 inch diameter ball and a conventional 3 inch diameter bat has a $D_{HZ}$ of: 3 inch+2(3inch)−2(½ inch)=8 inches.

This transforms into improved batting skills when using the regular bat and ball in a game. The mental confidence of the batter far outweighs the mechanics in hitting a ball. After practice with the present invention and the small hit zone of less than 3 inches, batters develop the mental attitude to improve their batting dramatically. The batter sees the ball 14 in the clear plastic tube 30 and anticipates the delivery. When the ball is delivered, the batter maintains eye contact on the ball and orients the small bat to hit the ball as it follows random trajectories. The batter can obtain far more hitting repetitions without fatigue (i.e., 50 to 300 repetitions per day versus 50 to 100 repetitions per day for conventional machines), with a ball delivered in a strike zone that they are able to hit more often with a lightweight narrowed bat, than they can with a regular baseball that is thrown by a human or machine and hit with a regular baseball bat.

9. General Discussion of Operation

In FIGS. 1 and 6, the general description of the operation of the present invention is illustrated. Blowing air from an air source 71 is directed into tube 52, and can be adjusted for speed by the air slots 53 or by a rheostat 72. This air is then accelerated by tab 51 (FIG. 7*a*), causing a reduction in pressure at point 41. This creates a vacuum in tube 30. When a ball 14*a* arrives at holes 11 and 2, the ball 14*a* is sucked down tube 30 and propelled out of shooting tube 90 to be hit by a batter.

Rotation of plate 10 is controlled by a combination of DC electric motor 12, gear box 16, and transformer 15 (or rheostat 15) to cause shaft 13 to rotate plate 10 to which it is attached in a suitable manner. Rotation of plate 10 determines the time difference between the balls delivered into tube 30 and the resultant delivery of the ball 14 out of tube 90.

The trajectory of the ball 14 can be changed by moving a pad 62 along the front leg 61 of the stand. The speed of the ball coming out of tube 71 can be varied by either (1) bypassing air out of the hole 54, or (2) using a rheostat 72 on the air source 71.

The present invention can deliver the lightweight balls at a wide variety of speeds through these adjustments. Speeds between 5 to 30 mph are preferred. The strike zone 410 (FIG. 4) is large and can range from 12 inches to 24 inches off center line 440. This compares to conventional strike zones for a pitching machine of 6 inches off center or less.

The lightweight ball 14 is then hit with a lightweight about one-inch-diameter bat 80 that has a bat grip 81 attached to give the batter the same feel and diameter of a game bat. The small ball and the small lightweight bat combined together give the batter a less than about 3-inch hitting zone.

As illustrated in FIG. 4, another important feature of the present invention is the wide variety of trajectories that the ball 14 can take in its delivery to the batter 400. This is entirely different from the delivery of balls from a conventional batting machine. Under the teachings of this invention, the delivery zone 410 is quite large. This is because as the balls 14 are hit, they may be slightly deformed so that when they are next delivered by the invention 420, and being of lightweight, they will occupy a different trajectory 430. The batter 400 never anticipates which trajectory 430 the ball 14 will take. This is an important part of the present invention since it improves the batter's coordination and prevents him/her from "grooving" their swing. The present invention, through repetitive use, trains the batter to keep the batter's eye on the moving ball so as to follow the ball to impact with the bat. This is the key to successful hitting.

10. Simplicity of Construction

Reference is now made to FIGS. 1 and 6 which illustrate the simplicity and low cost in the construction of the air-actuated ball-throwing device of the present invention. The 4-way connector 40 has four ports. One end of shooting tube 90 goes into one port, one end of support 250 goes into a second port, one end of delivery tube 52 goes into a third port, and one end of the dispensing tube 3 goes into a fourth port. The bin 1 simply sets on top of the other end of the dispensing tube 30, the flexible hose 30 connects to the other end of the delivery tube 52 and the other end of the support tube 50 engages yet another connector 60. The support also includes two tubes 61*a* and *b* and two tubes 63 *a* and *b*. They are mounted as shown in FIG. 6. A third connector 63*c* is also illustrated. Hence, seven tubes of the same diameter PVC piping can be utilized. Three conventionally available connectors 40, 60, and 63*c* are also utilized. Optional guards 65 can also be provided on the ends of the bottom support tubes as illustrated. Hence, the present invention can be easily assembled or disassembled and quickly moved from location to location.

The invention and its attendant advantages of simplicity will be understood from the foregoing description and it will be apparent that various changes could be made in form, construction, and materials used, without changing the scope or the simple operation. The examples used herein are merely an example, and I do not wish to be restricted to this specific form shown or uses mentioned except as defined in the accompanying claims.

I claim:

1. A method for a batter to practice batting, said method comprising the steps of:

providing a ball having a weight less than about two ounces and a diameter less than about two inches;

providing a bat for the batter having a diameter of about one inch;

providing a hit zone between said ball and said bat of less than about three inches; and automatically propelling said ball toward said batter from an air-activated ball-throwing device at speeds less than about thirty miles per hour in a random trajectory within a strike zone.

2. The method of claim 1, further comprising the step of displaying said ball to said batter immediately before the step of automatic propelling.

3. A method for a batter to practice batting, said method comprising the steps of:

providing a plurality of balls, each of said balls having a diameter of about two inches or less, each of said balls weighing less than about two ounces;

providing a bat for the batter having a diameter of about one inch so as to produce a hit zone between said ball and said bat of less than about three inches;

providing a clear dispensing tube having first and second ends, said first end of said dispensing tube receiving one of said plurality of balls;

providing a shooting tube having first and second ends;

pulling one of said plurality of balls through said dispensing tube into said first end of said shooting tube, said ball being displayed to said batter when in said clear dispensing tube; and then freely propelling said ball toward said batter out of said second end of said shooting tube.

* * * * *